US007150605B2

(12) United States Patent
Kim et al.

(10) Patent No.: US 7,150,605 B2
(45) Date of Patent: Dec. 19, 2006

(54) RECIPROCATING COMPRESSOR

(75) Inventors: Hyung-Jin Kim, Seoul (KR); Tae-Hee Kwak, Incheon (KR); Hyuk Lee, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 363 days.

(21) Appl. No.: 10/642,682

(22) Filed: Aug. 19, 2003

(65) Prior Publication Data

US 2004/0042914 A1 Mar. 4, 2004

(30) Foreign Application Priority Data

Sep. 4, 2002 (KR) ..... 10-2002-0053313

(51) Int. Cl.
*F04B 39/00* (2006.01)

(52) U.S. Cl. ..... 417/417; 417/312

(58) Field of Classification Search ..... 417/312, 417/501, 490, 550, 551; 181/403
See application file for complete search history.

(56) References Cited

U.S. PATENT DOCUMENTS 5,451,727 A * 9/1995 Park ..... 181/229

FOREIGN PATENT DOCUMENTS

JP 52-23707 2/1977
KR 1999-57577 7/1999

OTHER PUBLICATIONS

English language Abstract of Korean 1997-0077640.
English language Abstract of 52-23707.

* cited by examiner

*Primary Examiner*—Anthony D. Stashick
*Assistant Examiner*—Samuel E. Belt
(74) *Attorney, Agent, or Firm*—Greenblum & Bernstein, P.L.C.

(57) ABSTRACT

A reciprocating compressor includes a case having a gas suction pipe and a gas discharge pipe. A frame unit is installed in the case and a compression unit, including a cylinder is installed in the frame unit. The compression unit has a plurality of slots formed in a longitudinal direction on its outer circumferential surface. A piston is coupled with a reciprocating motor so as to linearly and reciprocally move into and out of the cylinder and has a plurality of through holes formed at its outer side, communicating with the slots. The compression unit has a gas muffler member installed at an outer circumferential surface of the cylinder.

19 Claims, 7 Drawing Sheets

RECIPROCATING COMPRESSOR

CROSS-REFERENCE TO RELATED APPLICATIONS

The present disclosure relates to subject matter contained in Korean Application No. 2002-0053313, filed on Sep. 4, 2002, which is expressly incorporated herein by reference, in its entirety.

BACKGROUND OF THE INVENTION

1. Field of the Invention

The present invention relates to a reciprocating compressor and, more particularly, to a reciprocating compressor with an improved suction structure of a refrigerant gas that is capable of minimizing a suction loss due to suction overheating caused during operation.

2. Description of the Background Art

In general, a compressor constituting a refrigerating cycle unit compresses a refrigerant gas in a low temperature and low pressure state introduced from an evaporator and discharges a high temperature and high pressure refrigerant gas.

Compressors can be classified as a rotary compressor, a reciprocating compressor, a scroll compressor, or the like, according to a fluid compression method.

Particularly, the reciprocating compressor, which compresses and takes-in a fluid as a piston moves linearly, is generally divided into those that operate by a method in which a fluid is taken-in and compressed by switching or converting a rotational movement of a driving motor into a reciprocal movement of the piston, and those that operate by a method in which a fluid is taken-in and compressed by allowing the piston to make a reciprocal movement while the driving motor moves linearly and reciprocally.

FIG. 1 is a vertical-sectional view showing the inside of a conventional reciprocating compressor.

As depicted, the conventional reciprocating compressor includes a case 10 having a gas suction pipe (SP) and a gas discharge pipe (DP), a frame unit 20 having a front frame 21 and a rear frame 22 respectively installed at a front side and a rear side in the case 10 and a middle frame 23 installed at the middle portion between the front and rear frames 21 and 22. A reciprocating motor 30 is installed between the middle frame 23 and the rear frame 22 and generates a driving force, a compression unit 70 having a cylinder 40 is installed at the center of the front frame 21, and a piston 50 is linearly and reciprocally moved into the cylinder 40 by virtue of the driving force of the reciprocating motor 30. A discharge cover 61 is installed at the front side of the cylinder 40 and forms a compression chamber (P) therein, a discharge valve 62 is positioned inside the discharge cover 61 and selectively opens and closes the compression chamber (P), a valve spring 63 elastically supports the discharge valve 62, and a suction valve 64 coupled at the front surface of the piston 50 selectively opens and closes a gas suction passage (F) formed inside the piston 50. A spring unit 80 is installed between the front frame 20 and the middle frame 23 and provides an elastic force to the piston 50.

The reciprocating motor 30 includes an outer stator 31 fixed between the middle frame 23 and the rear frame 22, an inner stator 32 inserted into the outer stator 31 with a space therebetween, and a mover 34 reciprocally installed between the outer stator 31 and the inner stator 32 and connected to the piston 50.

In the conventional reciprocating compressor, the gas suction pipe (SP) is installed at the side of the rear frame 22 and a gas discharge pipe (DP) is installed at the side of the front frame 21. A suction muffler (M) is installed at the side of the rear frame 22 in order to cancel a suction noise generated during operation of the reciprocating compressor.

The operation of the reciprocating compressor constructed as described above will now be explained.

When power is supplied to the reciprocating motor 30, the mover 34 is linearly and reciprocally moved by virtue of a magnetic flux formed at the outer stator 31 and the inner stator 32.

At this time, the piston 50 connected to the mover 34 is linearly and reciprocally moved into a through hole. 41 of the cylinder 40.

At the same time, gas is introduced through the gas suction pipe (SP) of the case 10, and the introduced gas is taken into the compression chamber (P) according to the operation of the compression unit 70 and then discharged through the gas discharge pipe (DP).

However, in the conventional reciprocating compressor, after the refrigerant gas introduced into the gas suction pipe (SP) passes the reciprocating motor 30, it is taken into the compression chamber (P) through the suction passage (F) of the piston 50 and discharged into the discharge pipe (DP). In this process, however, a suction loss occurs due to generation of heat by the reciprocating motor 30. Such a suction loss due to the suction overheating of the reciprocating motor 30 causes a degradation in performance of the compressor.

In addition, in the conventional reciprocating compressor, the suction muffler (M) is installed at the rear frame 22 in order to minimize or remove a suction noise generated during operation. However, since the suction noise generated due to the reciprocal movement of the piston 50 is directly transmitted outside the compressor through the gas suction pipe (DP), not only the muffling effect is degraded but also the overall length (or height) of the compressor is increased due to such location of the suction muffler.

SUMMARY OF THE INVENTION

Therefore, an object of the present invention is to provide a reciprocating compressor that is capable of preventing a suction loss due to overheating of a reciprocating motor during operation by enhancing a suction structure of a refrigerant gas.

Another object of the present invention is to provide a reciprocating compressor that is capable of reducing a suction noise generated during operation by installing a refrigerant gas muffler member at an outer circumferential surface of a cylinder.

To achieve these and other advantages and in accordance with the purpose of the present invention, as embodied and broadly described herein, there is provided a reciprocating compressor including a case having a gas suction pipe, a gas discharge pipe and a frame unit provided inside the case. A compression unit includes a cylinder positioned in the frame unit and has a plurality of slots formed in a longitudinal direction on its outer circumferential surface. A piston is coupled with the reciprocating motor so as to linearly and reciprocally move into the cylinder and has a plurality of through holes, communicating with the slots, formed at its outer side. A gas muffler member is installed at an outer circumferential surface of the cylinder such that its one side communicates with the slots and the other side communicates with the gas suction pipe. A discharge cover is installed at the front side of the cylinder, has a compression chamber therein, and communicates with the discharge pipe. A discharge valve is positioned inside the discharge cover and selectively opens and closes the compression chamber. A valve spring elastically supports the discharge valve, and a suction valve is coupled at the front surface of the piston and to selectively open and close the gas suction passage formed inside the piston. A spring unit is installed at the frame unit so as to provide an elastic force to the piston.

To achieve the above objects, there is also provided a reciprocating compressor including a case having a gas suction pipe, a gas discharge pipe and a frame unit installed in the case. A compression unit includes a cylinder installed at the frame unit and having a plurality of slots formed in a longitudinal direction on its outer circumferential surface. A piston is coupled with the reciprocating motor so as to linearly and reciprocally move into the cylinder and has a plurality of through holes formed at its outer side, communicating with the slots.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
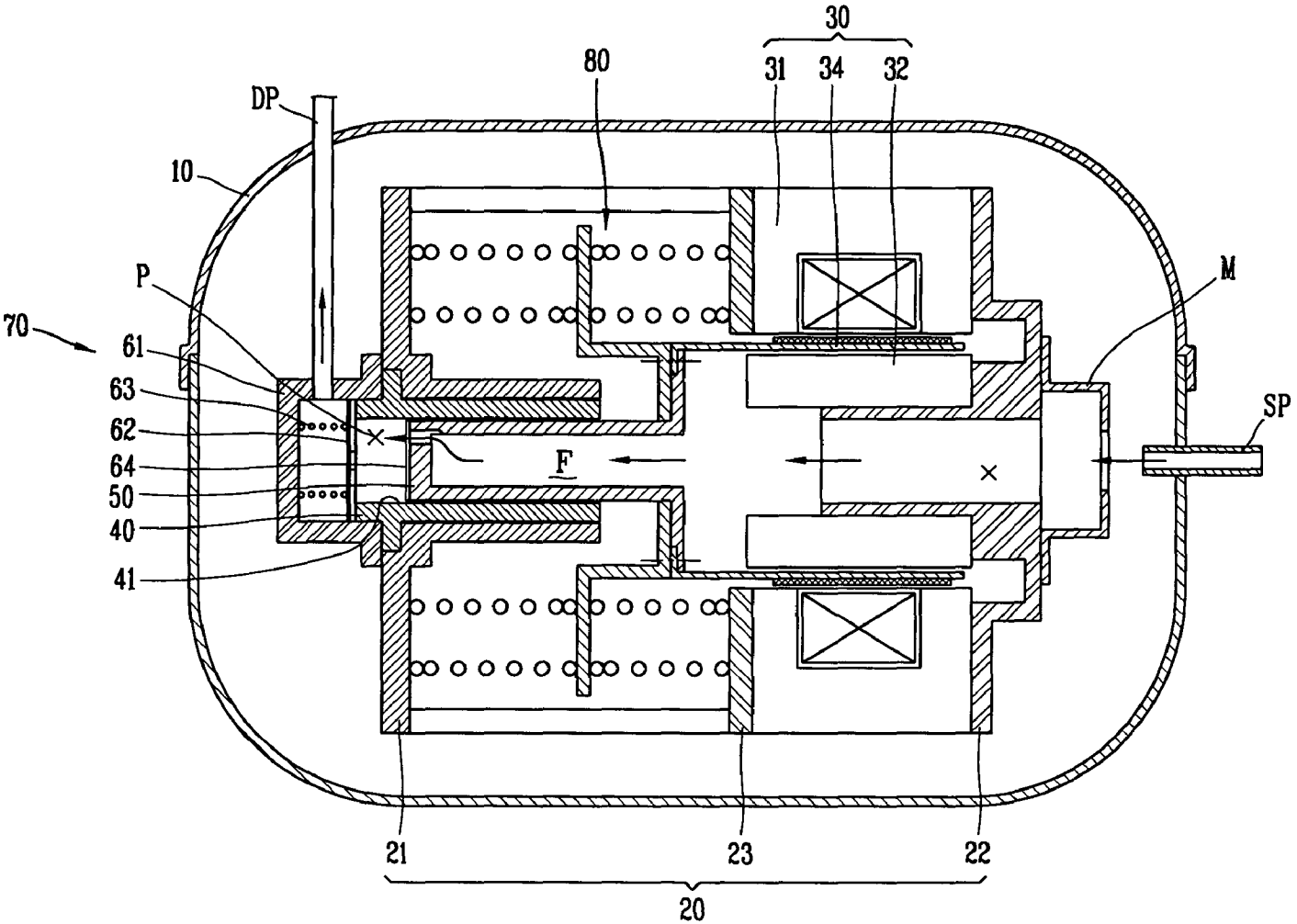
FIG. 1 CONVENTIONAL ART
FIG. 1 is a vertical-sectional view showing the inside of a reciprocating compressor in accordance with a conventional art.
Figure 2:
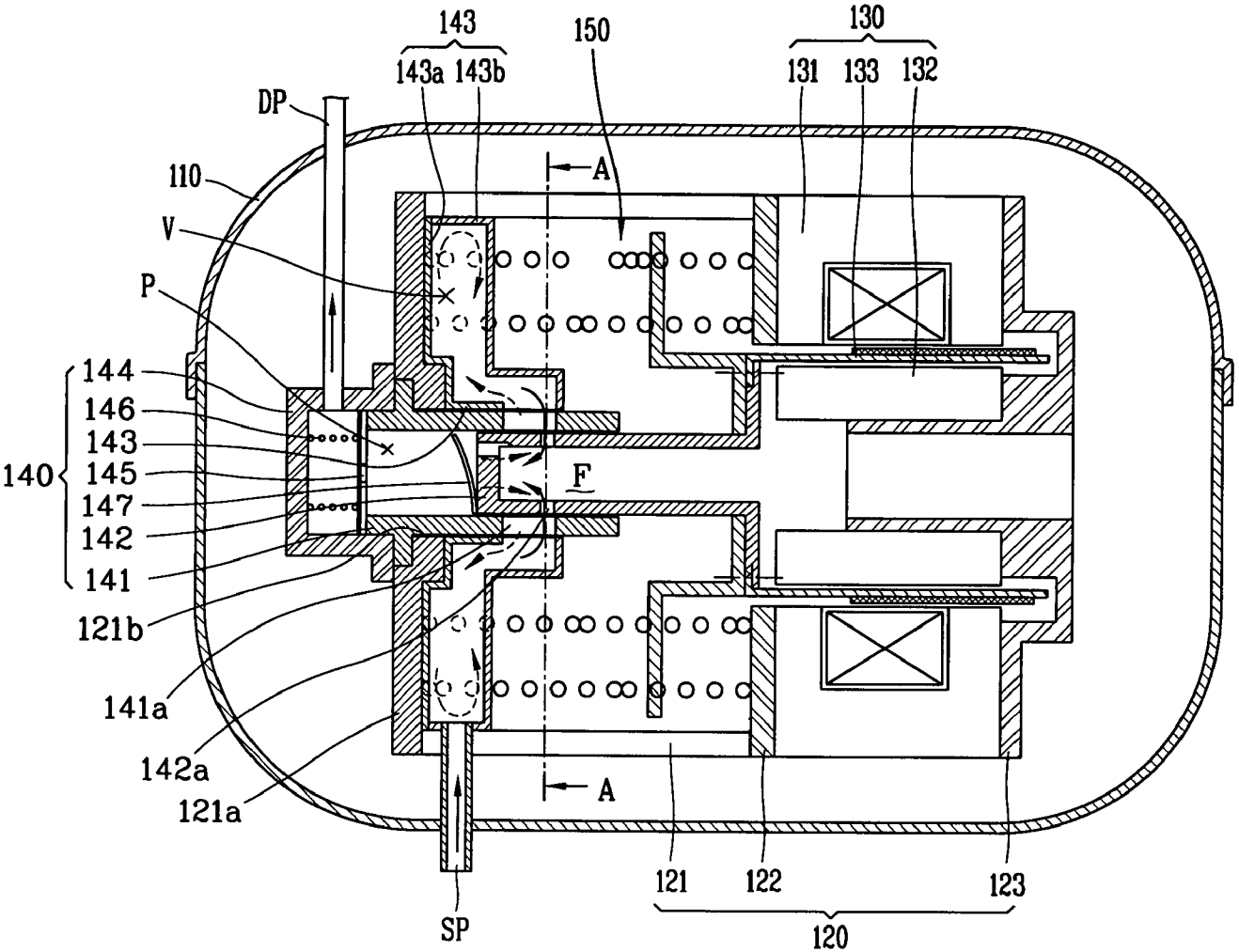
FIG. 2 is a vertical-sectional view showing a gas suction operation in the reciprocating compressor in accordance with one embodiment of the present invention.
Figure 3:
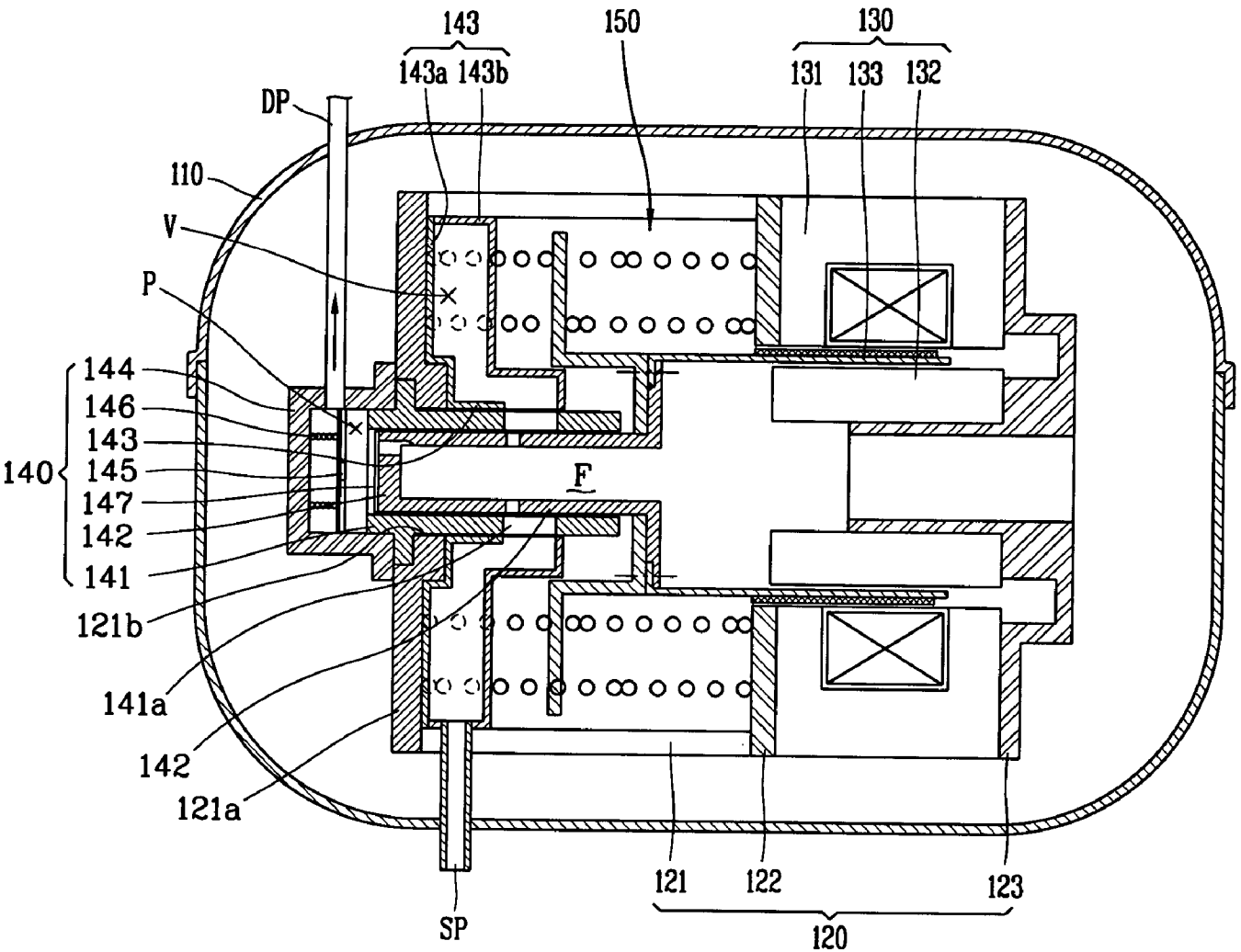
FIG. 3 is a vertical-sectional view showing a gas discharging operation in the reciprocating compressor in accordance with the embodiment of FIG. 2 of the present invention.
Figure 4:
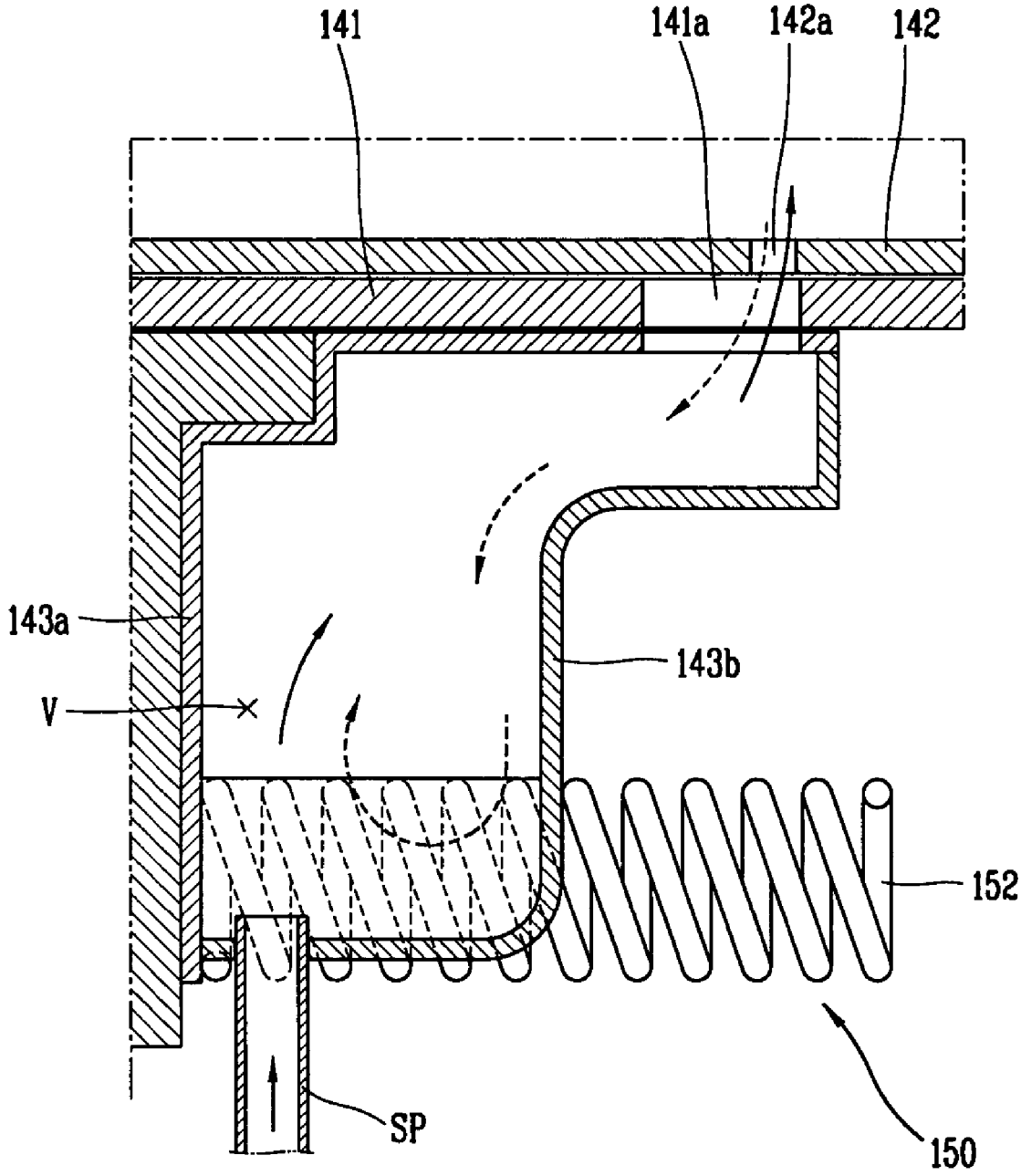
FIG. 4 is a vertical-sectional view showing a gas flow in the reciprocating compressor in accordance with the embodiment of FIG. 2 of the present invention.
Figure 5:
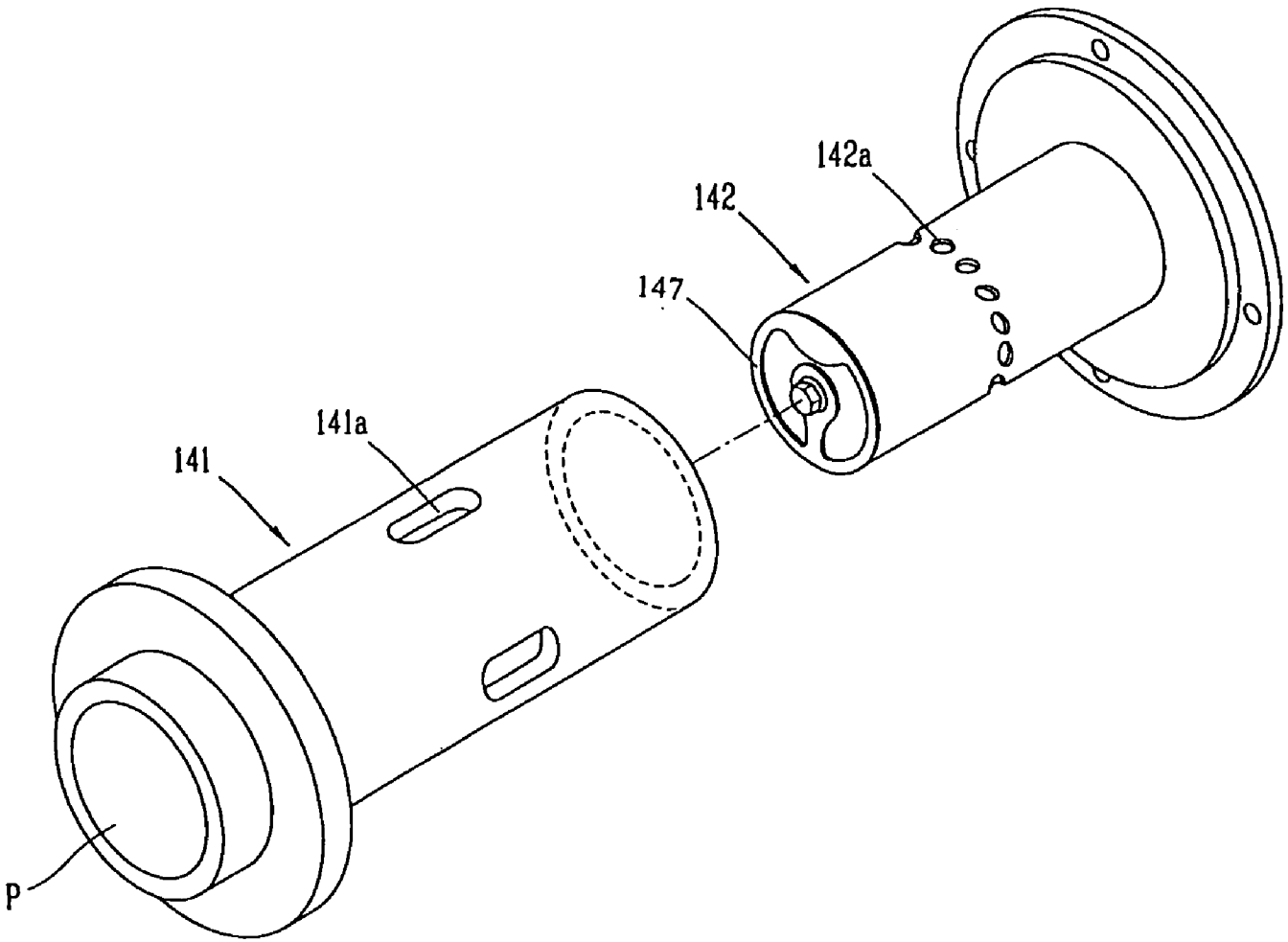
FIG. 5 is an exploded perspective view showing combination of a cylinder and a piston in accordance with the FIG. 2 embodiment of the present invention.
Figure 6:
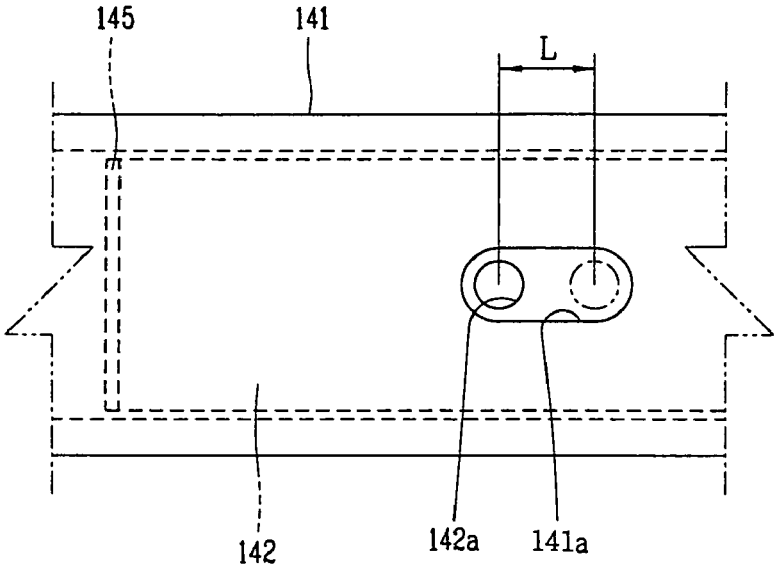
FIG. 6 is a plan view showing positions of slots and through holes in accordance with the FIG. 2 embodiment of the present invention.
Figure 7:
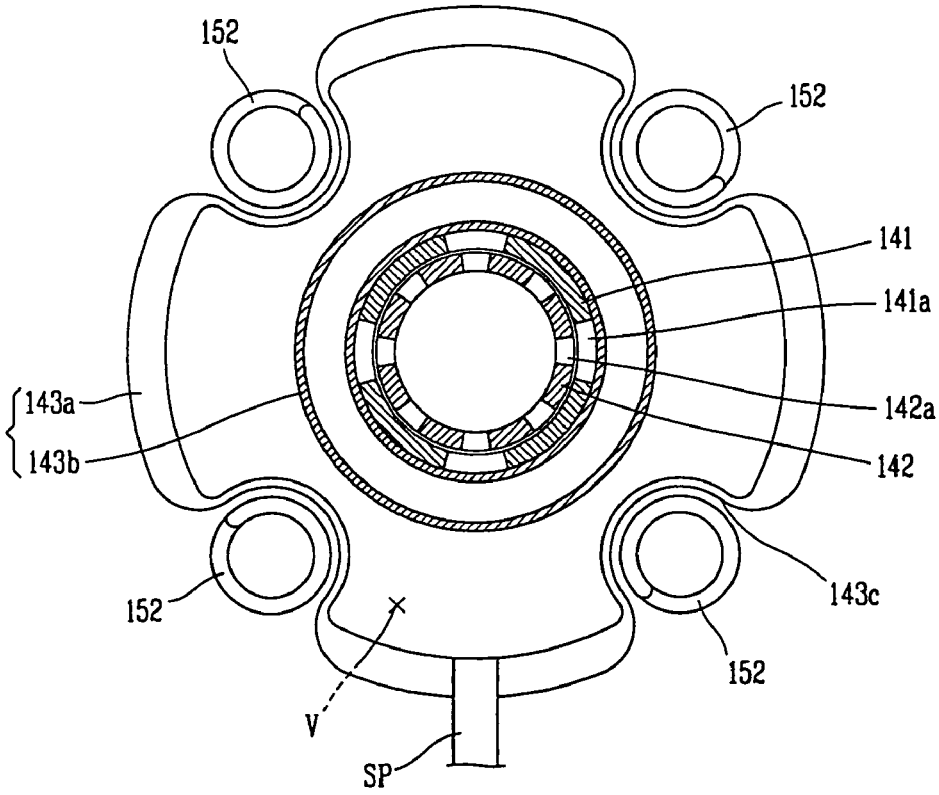
FIG. 7 is a sectional view taken along line A—A of FIG. 2.

FIG. 2 is a vertical-sectional view showing a gas suction operation in the reciprocating compressor in accordance with one embodiment of the present invention, FIG. 3 is a vertical-sectional view showing a gas discharging operation in the reciprocating compressor in accordance with the embodiment of FIG. 2 of the present invention, FIG. 4 is a vertical-sectional view showing a gas flow in the reciprocating compressor in accordance the embodiment of FIG. 2 of the present invention, FIG. 5 is an exploded perspective view showing combination of a cylinder and a piston in accordance with the FIG. 2 embodiment of the present invention, FIG. 6 is a plan view showing positions of slots and through holes in accordance with the FIG. 2 embodiment of the present invention, and FIG. 7 is a sectional view taken along line A—A of FIG. 2.

As illustrated, a reciprocating compressor in accordance with one embodiment of the present invention includes a case 110 having a gas suction pipe (SP) and a gas discharge pipe (DP). A frame unit 120 having a front and rear frames 121 and 123 are respectively installed at a front side and a rear side in the case 110 and a middle frame 122 installed at the middle portion of the front and rear frames 121 and 123. A reciprocating motor 130 is installed between the middle frame 23 and the rear frame 22 and generates a driving force. A compression unit 140 including a cylinder 141 is installed at the center of the front frame 121 and has a plurality of slots 141*a* formed on an outer circumferential surface in a longitudinal direction, and a piston 142 is connected to the reciprocating motor 130 so as to linearly and reciprocally move into the cylinder 141 and having a plurality of through holes 142*a* communicating with the slots. A gas muffler member 143 is installed at an outer circumferential surface of the cylinder 141 so that one side communicates with the slots 141*a* and the other side communicates with the gas suction pipe (SP). A discharge cover 144 is installed at the front surface of the cylinder 141, and has a compression chamber (P) therein, and communicates with the gas discharge pipe (DP). A discharge valve 145 is positioned inside the discharge cover 144 and selectively opens and closes the compression chamber (P), a valve spring 146 elastically supports the discharge valve 145, and a suction valve 147 is coupled at the front surface of the piston 142 and selectively opens and closes the gas suction passage (F) formed inside the piston 142. A spring unit 150 is installed between the front frame 121 and the middle frame 122 so as to provide an elastic force to the piston 142.

The reciprocating motor 130 is installed between the middle frame 122 and the rear frame 123 so that it can generate a driving force.

The reciprocating motor 130 includes an outer stator 131 fixed between the middle frame 122 and the rear frame 123, an inner stator 132 inserted into the outer stator 131 with a certain space therebetween, and a mover 133 installed to be movable linearly and reciprocally between the outer stator 131 and the inner stator 132, and connected to the piston 142.

The compression unit 140, taking-in a gas through the gas suction pipe (SP), compressing the gas and discharging it through the gas discharge pipe (DP), has the following construction.

First, the cylinder 141 is inserted at the center of the front frame 121, and a plurality of slots 141*a* are formed at an outer circumferential surface of the cylinder 141 and extend in a longitudinal direction.

The piston 142 is constructed such that its one end is fixed at the reciprocating motor 130 and the other end is inserted into the cylinder 141 for linear and reciprocal movement.

The plurality of through holes 142*a* communicating with the slots 141*a* are formed at an outer circumferential surface of the piston 142 which is in contact with the cylinder 141, as seen in FIG. 5.

The through holes 142*a* are maintained in position within a range of the slot 141*a* while the piston 142 linearly and reciprocally moves. In other words, the piston 142 takes-in and compresses a gas while linearly and reciprocally moving into the cylinder 141, and at this time, the piston 142 moves in the range that the through holes 142*a* and the slots 141*a* are maintained or positioned to communicate with each other as shown in FIG. 6.

When the piston 142 performs a gas suction operation, a gas introduced into the gas muffler member 143 through the gas suction pipe (SP) is introduced into the piston 142 through the slots 141*a* and the through holes 142*a* and is then introduced into the compression chamber (P) through the gas suction passage (F).

At this time, since the direction of the gas flowing through the slots 141*a* and the through holes 142*a* crosses or is transverse to the direction of the piston's reciprocal movement, a suction noise generated during operation is weakened.

The gas muffler member 143 is sealed surrounding the outer circumferential surface of the cylinder 141 and fixed at the front frame 121.

The inner circumferential surface of the gas muffler member 143 communicates with the slots 141*a* and its outer circumferential surface communicates with the gas suction pipe (SP) as shown in FIG. 4.

The gas muffler member 143 includes an inner housing 143*a* and an outer housing 143*b* coupled to the inner housing 143*a*.

An echo space (V) is formed inside the gas muffler member 143. Gas introduced into the echo space (V) of the gas muffler member 143 through the gas suction pipe (SP) is introduced into the gas suction passage (F) of the piston 142 after passing through the slots 141*a* and the through holes 142*a*.

Spring mounting grooves 143*c* are formed at four outer corners of the gas muffler member 143, for passing the front spring 152 therethrough.

The discharge cover 144 is installed at the front side of the cylinder 141 so as to form the compression chamber (P) therein, and communicates with the discharge pipe (DP).

The discharge valve 145 is positioned inside the discharge cover 144 and fixed at the front surface of the cylinder 141. The discharge valve 145 is opened only when the piston performs a compression operation, thereby discharging the gas from the compression chamber (P).

The valve spring 146 elastically supports the discharge valve 145, and the suction valve 147 is coupled at the front surface of the piston 142 and selectively opens and closes the gas suction passage (F) formed inside the piston 142.

The spring unit 150 is installed between the front frame 121 and the middle frame 122 so as to provide an elastic force to the piston 142.

The operation and effect of the reciprocating compressor in accordance with the present invention will now be described.

First, as for the operation of the reciprocating compressor, when power is supplied to the reciprocating motor 130, the mover 133 is linearly and reciprocally moved by a magnetic flux formed at the outer stator 131 and the inner stator 132.

At this time, the piston 142 connected to the mover 133 takes-in and discharges a gas while linearly and reciprocally moving in the cylinder 141.

As shown in FIG. 2, during the gas suction operation, the gas is introduced into the echo space (V) of the gas muffler member 143 through the gas suction pipe (SP) of the case 110 until the piston 142 is rearwardly moved to reach a bottom dead center (that is, until the piston completely expands the compression chamber), and the introduced gas is introduced into the compression chamber (P) after passing through the slots 141*a*, the through holes 142*a*, the gas suction passage (F) of the piston 142 and the suction valve 147.

As shown in FIG. 3, during the gas compression and discharging operation, the compressed gas is discharged through the discharge valve 145 and the discharge pipe (DP) of the compression chamber (P) until the piston 142 is advanced or moved forwardly to reach an upper dead center (that is, until the piston completely compresses the compression chamber).

In the present invention, unlike the conventional art, gas is taken-in through the gas muffler member 143 installed at an outer circumference of the cylinder 142 in a roundabout way, not by way of the reciprocating motor, so that suction overheating due to the reciprocating motor 130 can be effectively prevented.

In addition, since the gas muffler member 143 is installed at an outer circumferential surface of the cylinder 142 to guide gas flowing, and the flow of gas discharged from the gas muffler member 143 crosses the direction of the piston movement, the suction noise and vibration generated during the operation are introduced into the echo space (V), not directly transmitted to outside of the case 10, and mostly die according to a Helmholtz effect.

Figure 8:
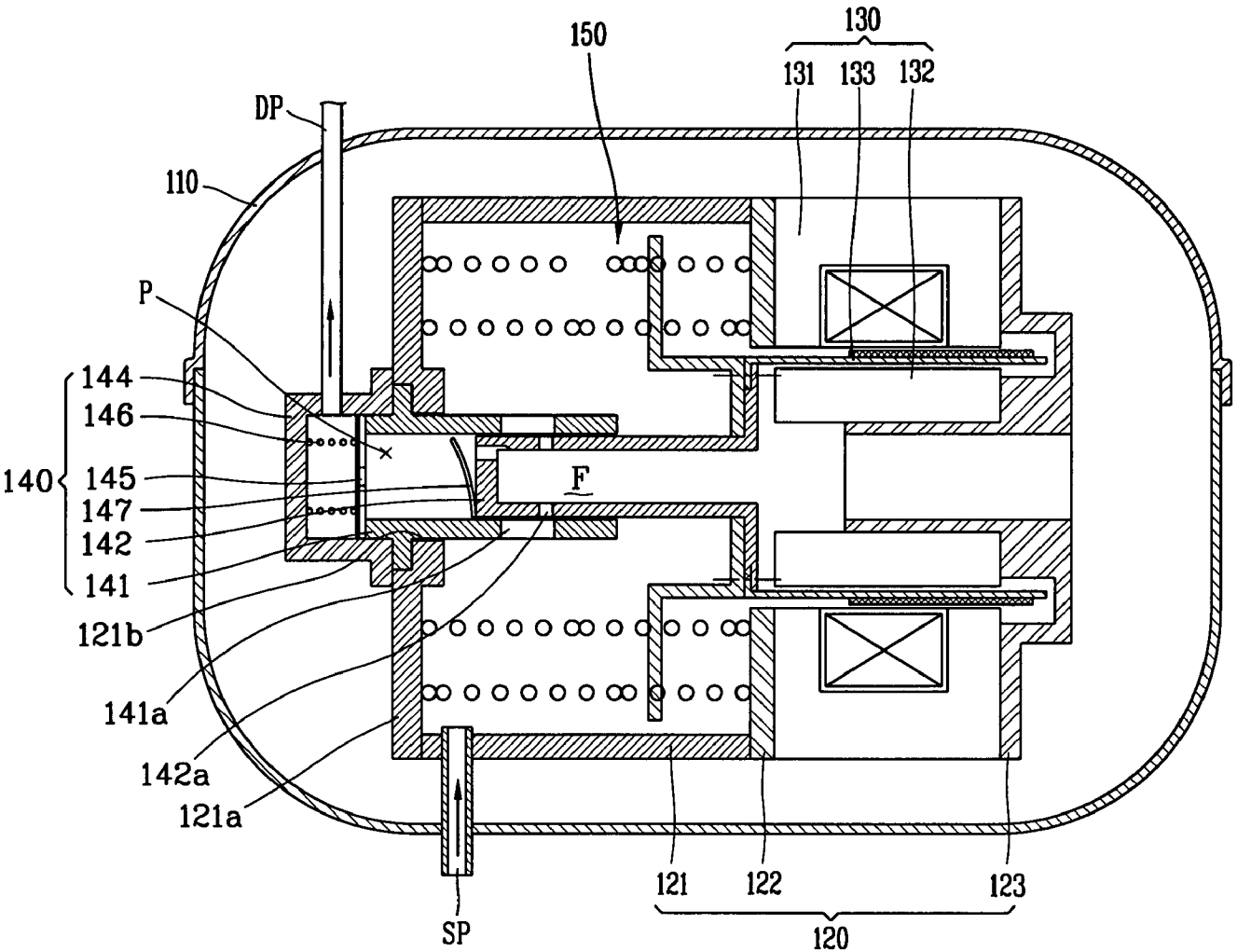
FIG. 8 is a vertical-sectional view showing a reciprocating compressor in accordance with another embodiment of the present invention.

FIG. 8 is a vertical-sectional view showing a reciprocating compressor in accordance with another embodiment of the present invention.

As illustrated, even though the gas muffler member 143 (refer to FIG. 2) is not utilized, a gas introduced into the case 110 through the gas suction pipe (SP) is taken into the compression chamber (P) after passing through the slots 141*a*, the through holes 142*a* and the suction passage (F) and is then discharged through the gas discharge tube (DP) according to compression of the piston 142, the reciprocation of which are repeatedly performed.

As so far described, the reciprocating compressor of the present invention has an advantage that, since it has a structure that the suction gas is introduced into the gas muffler member, the suction loss due to the suction overheating generated by the reciprocating motor can be prevented, the suction noise and vibration can be minimized, and the compressor can be made compact in size.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A reciprocating compressor comprising:

a case having a gas suction pipe and a gas discharge pipe;

a frame unit positioned in the case; and a compression unit comprising a cylinder positioned at the frame unit and having a plurality of slots formed in a longitudinal direction on an outer circumferential surface, a piston coupled with a reciprocating motor so as to linearly and reciprocally move into the cylinder and having a plurality of through holes formed at an outer side, said through holes communicating with the slots, and a compression unit having a gas muffler member positioned at an outer circumferential surface of the cylinder, as an additional member, wherein a gas suction passage is provided inside the piston, and the gas suction passage communicates with the slots and the through holes.

2. The compressor of claim 1, wherein the through holes are configured to remain within a range of the slots while the piston linearly and reciprocally moves.

3. The compressor of claim 1, wherein the direction of gas flowing through the slots and the through holes is transverse to the direction of the piston movement.

4. The compressor of claim 1, wherein an echo space is formed inside the gas muffler member configured to absorb suction noise and vibration generated during an operation of the compressor.

5. The compressor of claim 1, wherein the gas introduced into the gas muffler member through the gas suction pipe is introduced into the suction passage of the piston after passing through the slots and the through holes.

6. The compressor of claim 1, wherein a plurality of spring receiving grooves are formed at an outer side of the gas muffler member.

7. The compressor of claim 1, wherein the gas muffler member includes an inner housing and an outer housing coupled to the inner housing.

8. The compressor of claim 1, wherein the gas muffler member communicates with the slots at one side thereof.

9. The compressor of claim 8, wherein the gas muffler member communicates with the gas suction pipe.

10. A reciprocating compressor comprising:

a case having a gas suction pipe and a gas discharge pipe;

a frame unit positioned in the case;

a compression unit comprising a cylinder positioned at the frame unit and having a plurality of slots formed in a longitudinal direction on an outer circumferential surface, and a piston coupled with a reciprocating motor so as to linearly and reciprocally move into the cylinder and having a plurality of through holes formed at an outer side, said through holes communicating with the slots; and a gas muffler member positioned at an outer circumferential surface of the cylinder and configured to be directly connected with the gas suction pipe as an additional member, wherein a gas suction passage is provided inside the piston, and the gas suction passage communicates with the slots and the through holes.

11. The compressor of claim 10, wherein the through holes are configured to remain within a range of the slots while the piston linearly and reciprocally moves.

12. The compressor of claim 10, wherein the direction of gas flowing through the slots and the through holes is transverse to the direction of the piston movement.

13. The compressor of claim 10, wherein an echo space is formed inside the gas muffler member configured to absorb suction noise and vibration generated during an operation of the compressor.

14. The compressor of claim 10, wherein the gas introduced into the gas muffler member through the gas suction pipe is introduced into the suction passage of the piston after passing through the slots and the through holes.

15. The compressor of claim 10, wherein a plurality of spring receiving grooves are formed at an outer side of the gas muffler member.

16. The compressor of claim 10, wherein the gas muffler member includes an inner housing and an outer housing coupled to the inner housing.

17. The compressor of claim 10, wherein the gas muffler member communicates with the slots at one side thereof.

18. The compressor of claim 17, wherein the gas muffler member communicates with the gas suction pipe.

19. A reciprocating compressor comprising:

a case having a gas suction pipe and a gas discharge pipe;

a frame unit positioned in the case; and a compression unit comprising a cylinder positioned at the frame unit and having a plurality of slots formed in a longitudinal direction on an outer circumferential surface, and a piston coupled with a reciprocating motor so as to linearly and reciprocally move within the cylinder and having a plurality of through holes formed at an outer side, the through holes communicating with the slots, wherein the gas suction pipe is provided near the through holes and configured to introduce suction gas without passing the way of the reciprocating motor, as an additional member, wherein a gas suction passage is provided inside the piston, and the gas suction passage communicates with the slots and the through holes.

* * * * *